US010870124B2

(12) United States Patent
Doll et al.

(10) Patent No.: US 10,870,124 B2
(45) Date of Patent: Dec. 22, 2020

(54) METHOD AND SYSTEM FOR COVERING INNER WALLS OF A CAVITY WITH A PROTECTIVE LAYER MADE OF ANTI-CORROSION WAX OR ANTI-CORROSION AGENT

(71) Applicant: IPR—INTELLIGENTE PERIPHERIEN FÜR ROBOTER GMBH, Eppingen (DE)

(72) Inventors: Fredy Doll, Achern (DE); Marc Engelhart, Sinsheim (DE); Bernhard Woll, Erdmannhausen (DE)

(73) Assignee: IPR- INTELLIGENTE PERIPHERIEN FÜR ROBOTER GMBH, Eppingen (DE)

( * ) Notice: Subject to any disclaimer, the term of this patent is extended or adjusted under 35 U.S.C. 154(b) by 5 days.

(21) Appl. No.: 16/070,447

(22) PCT Filed: Feb. 9, 2017

(86) PCT No.: PCT/EP2017/052932
§ 371 (c)(1),
(2) Date: Jul. 16, 2018

(87) PCT Pub. No.: WO2017/137520
PCT Pub. Date: Aug. 17, 2017

(65) Prior Publication Data

US 2019/0022686 A1 Jan. 24, 2019

(30) Foreign Application Priority Data

Feb. 9, 2016 (EP) ..... 16154796

(51) Int. Cl.
*B05B 13/06* (2006.01)
*B05D 7/22* (2006.01)
(Continued)

(52) U.S. Cl.
CPC ..... *B05B 13/0627* (2013.01); *B05B 12/06* (2013.01); *B05D 1/02* (2013.01);
(Continued)

(58) Field of Classification Search
None
See application file for complete search history.

(56) References Cited

U.S. PATENT DOCUMENTS 3,202,363 A 8/1965 Kautz et al.
3,227,572 A 1/1966 Rundle et al.
(Continued)

FOREIGN PATENT DOCUMENTS

CN 102 601 010 A 7/2012
DE 30 06 908 A1 9/1981
(Continued)

OTHER PUBLICATIONS

International Search Report with English translation and Written Opinion issued in Application No. PCT/EP2017/052932, dated May 10, 2017 (15 pages).
(Continued)

*Primary Examiner* — Shamim Ahmed
*Assistant Examiner* — Bradford M Gates
(74) *Attorney, Agent, or Firm* — Flynn Thiel, P.C.

(57) ABSTRACT

A method for covering inner walls of a cavity with a protective layer made of anti-corrosion wax, in particular for use on vehicle bodies and add-on parts for vehicle bodies. Anti-corrosion wax is brought into an atomized form (protective agent mist) by a mist generator and supplied through an outlet opening to the cavity to be preserved. The protective agent mist is deposited on inner walls of the cavity and forms an anti-corrosion agent layer.

22 Claims, 5 Drawing Sheets

(51) Int. Cl.

| | |
|---|---|
| ***B05B 12/06*** | (2006.01) |
| ***B05D 1/02*** | (2006.01) |
| *B05D 7/14* | (2006.01) |
| *B05D 3/02* | (2006.01) |
| *B05B 7/10* | (2006.01) |

(52) U.S. Cl.
CPC ..... *B05D 7/22* (2013.01); *B05B 7/10* (2013.01); *B05D 3/0218* (2013.01); *B05D 7/14* (2013.01); *B05D 2259/00* (2013.01); *B05D 2501/10* (2013.01)

(56) References Cited

U.S. PATENT DOCUMENTS

| | | | | |
|---|---|---|---|---|
| 3,488,213 | A | 1/1970 | Bellato | |
| 3,673,463 | A | 6/1972 | Gourdine | |
| 4,314,670 | A * | 2/1982 | Walsh, Jr. | B05B 7/0416 239/11 |
| 4,424,838 | A | 1/1984 | Noack | |
| 4,454,173 | A | 6/1984 | Koga | |
| 4,505,613 | A | 3/1985 | Koga | |
| 5,066,518 | A | 11/1991 | Klingen | |
| 2004/0124292 | A1 * | 7/2004 | Giuliano | B05B 5/1625 239/690 |
| 2011/0014385 | A1 * | 1/2011 | Ahonen | B05D 1/02 427/421.1 |

FOREIGN PATENT DOCUMENTS

| | | | |
|---|---|---|---|
| DE | 30 43 246 | A1 | 12/1981 |
| DE | 33 15 364 | A1 | 11/1983 |
| DE | 33 15 465 | A1 | 11/1983 |
| DE | 10 2009 052089 | A1 | 6/2010 |
| EP | 0028088 | A1 | 5/1981 |
| FR | 3 014 334 | A3 | 6/2015 |
| GB | 867 303 | | 5/1961 |
| JP | S58 189074 | A | 11/1983 |
| JP | S5952570 | A | 3/1984 |
| JP | S59 150578 | A | 8/1984 |
| WO | WO 96/14166 | A1 | 5/1996 |

OTHER PUBLICATIONS

European Patent Office Search Report issued in Application No. 16154796.3 with English translation of category of cited documents, dated Aug. 9, 2016 (10 pages).

Chinese Office Action with English Translation issued in corresponding Chinese Application No. 201780010667.1 dated Jun. 16, 2020 (24 pages).

* cited by examiner

METHOD AND SYSTEM FOR COVERING INNER WALLS OF A CAVITY WITH A PROTECTIVE LAYER MADE OF ANTI-CORROSION WAX OR ANTI-CORROSION AGENT

FIELD OF USE AND PRIOR ART

The invention relates to a method for covering inner walls of a cavity with a protective layer made of anti-corrosion wax or a wax-based anti-corrosion agent, in particular for use on vehicle bodies and add-on parts for vehicle bodies.

The invention furthermore relates to a system for carrying out the method.

Methods of the type in question are used in vehicle manufacturing in order to protect body parts and in particular cavities of bodies and add-on parts thereof, such as flaps, doors and the like, against environmental influences. This typically takes place by anti-corrosion wax being applied to the relevant surfaces either by spraying, or by the relevant surfaces being covered by flooding of the cavities with anti-corrosion wax and subsequently removing excess protective wax.

The two methods are not ideal for every intended use. The spraying of anti-corrosion wax does not make it possible, in the case of complex geometries, to reach all of the surfaces of the cavity starting from an outlet point of the protective wax. Spray shadow regions which cannot be reached can remain on the far side of, for example, bulkhead plates, which are effective for reinforcement. Constricting geometries, such as, for example, intermediate regions of double-walled configurations, can also be difficult to reach by spraying. The flooding with anti-corrosion wax requires a large amount of energy and quantities of protective wax and is made difficult by the requirement to remove the excess protective wax. Furthermore, improvements in the cycle times during the application of anti-corrosion wax by means of flooding can be achieved only with difficulty.

Problem and Solution

The problem addressed by the invention is to provide a technically uncomplicated method and a system provided for this purpose, by means of which reliable covering of inner surfaces of a cavity is possible with low use of protective agent.

According to the invention, the following method is provided: anti-corrosion wax or a wax-based anti-corrosion agent is brought into an atomized form (protective agent mist) by means of a mist generator and supplied through an outlet opening to the cavity to be preserved. The protective agent mist is deposited on inner walls of the cavity and forms an anti-corrosion agent layer here.

The anti-corrosion agent used in the case of the method according to the invention can be designed as an anti-corrosion wax and as such has a wax portion (mineral oil based wax/paraffin) of at least 50% by weight. However, wax-based anti-corrosion agents having a smaller wax portion of at least 5% by weight and preferably between 5% by weight and 15% by weight are also usable. Such anti-corrosion agents can in particular also contain a portion of between 15% by weight and 30% by weight of a polyester resin. This imparts high heat stability to the applied protective agent layer after thorough drying.

The term "anti-corrosion agent" is used below which comprises both classic anti-corrosion wax with a high wax portion and also anti-corrosion agent with a lower wax portion.

According to the invention, it is provided that a mist atmosphere of anti-corrosion agent and gas is generated within the cavity, or such a mist atmosphere is supplied to the cavity. Said mist atmosphere consists of gas, in particular of air, and very fine droplets of the anti-corrosion agent. Said droplets are atomized to a sufficiently small size in order to be able to be suspended in the surrounding air. For this purpose, the average size of the droplets of the anti-corrosion agent in the mist is preferably <60 μm, particularly preferably <30 μm or even <10 μm on average. Such a protective agent mist is generated by means of a suitable mist generator. The latter can be, for example, a single-substance nozzle to which the anti-corrosion agent is supplied at high pressures. This is explained in more detail below. However, in comparison to the single-substance nozzle which is operated at high pressures, a two-substance nozzle is considered advantageous since very small droplets can likewise be produced here at lower pressures.

All the average droplet diameters referred to in this document relate to number-averaged diameters, i.e. relate to the sum of the droplet diameters divided by the number of droplets.

The production of mist is also known from wax spraying as an undesirable side effect, for example from DE 102009052089 A1. However, according to the invention, formation of a spray jet, the droplets of which impact directly against an inner wall of the cavity, is not desirable. Instead, the mist generation takes place in a targeted manner. For this purpose, the discharge operation is preferably of a type such that, in particular by selection of the nozzle used and the pressure at which the anti-corrosion agent and optionally compressed air are supplied, at least 50%, preferably at least 80%, of the droplets produced have a size which differs by no more than 20% from the average droplet size mentioned.

The mist atmosphere of the protective agent mist, which is introduced according to the invention into the cavity for the purpose of coating surfaces, unlike in the case of spraying the anti-corrosion agent, is mainly deposited not directly on the walls of the cavity, but rather is first of all distributed in the cavity and is then deposited even on surfaces which would not be directly accessible by spraying from the outlet opening.

In order to produce said mist atmosphere, the size of the droplets and the outlet speed and optionally also the influencing of the mist which is produced are preferably selected in such a manner that at least 50% of the volumetric flow of the introduced protective agent needs 5 seconds or more until the droplets have been deposited on the walls. There therefore remains time for the mist atmosphere to be distributed substantially homogeneously in the cavity.

By targeted heating or cooling of the walls of the cavity, the manner of deposition of the protective agent and the formation of layers can be influenced. Furthermore, it is also possible to influence the deposition by electrostatically charging up the protective agent before or during the discharge, and/or by charging the walls.

Depending on the type of protective agent, the solidification can be brought about by an increased temperature and a reduced temperature of the protective agent. Depending on the anti-corrosion agent used, chemical drying, radiation drying or drying by air flow is also possible.

The protective agent mist can remain in the cavity or can be sucked out of the latter when the method is finished.

The types of wax customarily already used nowadays for spraying or flooding in order to preserve cavities in vehicles are suitable as the anti-corrosion agent to be used. Purely by way of example, reference is made to the anti-corrosion wax with the trade name Eftec Efcoat WH 320 A1 which can be used here. Further anti-corrosion agents which are mentioned by way of example and can be discharged by means of the method according to the invention are the anti-corrosion agents obtainable under the trade names Anticorit CPX 3373 LV and Anticorit DS 329 DE. Anticorit CPX 3373 here is an anti-corrosion agent based on wax with a wax portion of approximately 5 to 15% by weight with an addition of a portion of between 15% by weight and 30% by weight of a polyester resin. Such wax-based anti-corrosion agents have proven particularly readily suitable for the atomization. Such an anti-corrosion agent preferably furthermore comprises a filler, in particular with a portion of between 15% by weight and 25% by weight, and/or additives, such as anti-corrosion additives, with a portion of 10% by weight to 20% by weight.

The viscosity of the anti-corrosion agent used is preferably below 750 mPas, particularly preferably below 600 mPas. Such low-viscosity anti-corrosion agents have proven advantageous in order to generate the desired protective agent mist.

The droplets of the protective agent mist can emerge from the outlet opening at a speed of <10 m/s, in particular <5 m/s, preferably <2 m/s, particularly preferably <0.5 m/s.

By means of the comparatively slow emergence of the protective agent mist from the outlet opening, the formation of a mist atmosphere is promoted. Speeds which are too high can lead to too large a portion of the droplets striking directly against a flat wall of the cavity, despite a small droplet size, and therefore no longer being able to contribute to forming a mist atmosphere.

The speed of the discharged droplets is not completely uniform. The two-substance nozzles preferably used for generating mist, for example a nozzle of the type Miniquest from Dusen-Schlick GmbH from Untersiemau/Coburg, thus generate droplets of differing speed. The speed is customarily highest in a center of the arising mist cloud. The above-stated speed values do not take said particularly rapid droplets into consideration. They relate to that 80% of the discharged volumetric flow formed by the slowest droplets.

It is considered advantageous if, during the supplying of the protective agent mist into the cavity at a first introduction point, a gas is supplied to the cavity at a second introduction point differing therefrom, in order to influence the protective agent mist in the cavity in respect of its direction of flow and/or in order to reduce the speed of the protective agent mist.

Said gas, which can be in particular air, is preferably supplied through a second opening in walls of the cavity, wherein said opening is particularly preferably arranged at a site of the cavity that lies opposite the mist generator.

The supply of gas serves in particular for the purpose of producing a type of gas or air cushion which is capable of preventing the direct impact of droplets of the protective agent mist on one of the walls of the cavity. A counterpressure opposed to the propagation of the droplets is generated, by means of which the droplets are braked such that they become part of a mist atmosphere.

Since the covering of the walls by means of a mist reliably deploys the desired preservation effect even at comparatively low layer thicknesses and since too high a volumetric portion of the droplets in the mist increases the risk of droplets combining to form larger droplets which are deposited more rapidly, a particularly small volumetric flow into the cavity is considered particularly advantageous, in particular a volumetric flow of the anti-corrosion agent of less than 200 g/minute, preferably less than 100 g/minute, particularly preferably less than 50 g/minute. These values are significantly below the values which are customary during the known spraying of anti-corrosion wax and which lie within the range of 500 g/minute and more.

It can be expedient to set the arising mist atmosphere into motion in a targeted and in particular cyclic manner. This can be controlled by the speed and outlet direction of the emerging protective agent mist. The control of this movement by energy supplied in some other way is also possible.

The protective agent mist can be supplied at a plurality of points or at changing points within the cavity to be preserved. The protective agent mist can also be supplied by means of a plurality of mist generators which are arranged at different points within the cavity to be preserved and/or are arranged in different directions relative to the cavity to be preserved.

Even if the introduction of the protective agent mist at only one point of the cavity may basically be sufficient since the protective agent mist is distributed in the cavity, a particularly good and rapid distribution of the mist can be promoted by the additional measures mentioned. The mist atmosphere can be created from both ends through a plurality of outlet openings which are arranged, for example, at opposite ends of an elongate cavity. A fairly homogeneous mist atmosphere can be created with only one outlet opening by an outlet opening which is movable within the cavity and discharges at different points. By a plurality of outlet openings which point in different directions, it can be particularly readily ensured, in particular in cooperation with a common movement of said outlet openings through the cavity, that the mist atmosphere reaches even surface regions to which access is difficult.

The supplying of protective agent mist via a plurality of mist generators can take place, for example, by use of a two-substance nozzle in combination with the abovementioned supplying of gas. The effect achieved by introducing protective agent mist through two nozzles oriented approximately in an opposed manner is that said nozzles in a particularly advantageous manner produce a stationary mist cloud, the droplets of which are not deposited directly on walls of the cavity directly after being introduced into the cavity.

By generation of a pressure difference between two spaced-apart partial regions of the cavity, the protective agent mist can be moved within the cavity.

By alternating generation of a positive pressure and a negative pressure in at least one partial region of the cavity, a periodically repeated movement of the protective mist can be generated in the cavity.

The protective agent mist is indeed distributed substantially homogeneously in the cavity basically in an independent manner. Since, however, short cycle times are desired depending on the intended use, it can be of advantage in particular to move the protective agent mist in a targeted manner in the cavity by means of a local positive pressure or negative pressure. This can take place, for example, by the introduction or sucking off of air at an opening of the cavity, either through a pressure opening, which is separate from the outlet opening, in the system for preserving cavities, or through the outlet opening itself. By means of periodically repeated increases or reductions in pressure, a cyclic movement of the protective agent mist can be generated in the cavity, by means of which a particularly favorable deposition behavior of the protective agent on the surface is achieved.

It has likewise been determined that a distribution of the droplets of the protective agent mist can be influenced positively if the introduction takes place in a pulsed manner. This is understood as meaning that the parameters of the mist generation by the at least one mist generator repeatedly change. For example, the pressure of the air supplied to the mist generator could periodically fluctuate. However, it is particularly simple to realize and advantageous in effect if the supply of mist by means of the mist generator takes place in a pulsed manner, in each case interrupted by phases in which no mist generation by the mist generator is provided. The average frequency of the pulsed mode preferably lies between 0.1 Hz and 5 Hz.

It is also possible for use to be made of two mist generators which are operated in such a manner that a first of the two mist generators and a second of the two mist generators alternately discharge the relatively greater volumetric flow. Accordingly, in this case two mist generators are provided which are spaced apart from each other, are controllable separately and alternately discharge the respectively greater volumetric flow of anti-corrosion agent. Also by this means, a periodically recurring movement of the mist can be produced, which brings about a rapid and homogeneous distribution of the mist.

A typical workpiece which is protected against corrosion with the methods according to the invention is the partial region of a body with an elongate cavity. In such a case, it is possible to allow the protective mist to emerge through the outlet opening in alignment with the main direction of extent of the cavity.

However, the protective mist can also emerge from the outlet opening in a direction which is angled in relation to the main direction of extent of such a cavity.

The effect which can be achieved by an angled outlet direction through the outlet opening is that the protective mist moves helically within the preferably elongate cavity, which promotes the deposition on all surfaces.

A similar effect can be achieved by provision of an influence which takes place after the mist has emerged through the outlet opening. After emerging from the outlet opening, the protective agent mist can be influenced in a targeted manner in respect of its movement direction, in particular by air being supplied from air nozzles different from the outlet opening. By means of the alignment of said air nozzles in a manner angled in relation to one another, said air nozzles are likewise capable of bringing about such a helical movement of the mist atmosphere.

However, other techniques are also possible in order to influence the movement of the mist within the cavity in a targeted manner. These include, for example, magnetism and electrostatics as useful active principles.

For the generation of the mist, diverse technologies already known from the prior art can be used. Mist nozzles are already known from other regions of the prior art.

In one possible refinement, the anti-corrosion agent is exclusively pressurized and atomized through a narrow single-substance nozzle. In this case, the liquid anti-corrosion agent is preferably supplied at a pressure of at least 20 bar, particularly preferably at least 60 bar. Even higher pressures, in particular above approximately 100 bar, are of particular advantage. The atomization can indeed be influenced positively by a further significant exceeding of this value. On the far side of 120 bar, however, there is such a great outlay on handling the protective agent prior to discharge that this should customarily be refrained from.

In an alternative configuration, mixing of anti-corrosion agent and air, which are both pressurized, takes place before or during the emergence of the protective agent mist. The pressurized air breaks up the anti-corrosion agent, which is supplied in liquid form, and thereby generates the mist.

It has been shown that this technology permits mist generation with a sufficiently small droplet size even at comparatively low pressures. In this case, the operation is preferably carried out with a positive supply pressure of between 1 bar and 3 bar for the anti-corrosion agent and between 1 bar and 5 bar for the air. By means of the low pressures, the overall outlay on the method is lower than when single-substance nozzles are used, in which higher pressures are required.

During the use of a two-substance nozzle, it has proven advantageous for the atomization for the purpose indicated here if the two-substance nozzle is fed with air in such a manner that said air is accelerated to above 100 m/s, ideally to approximately 250 m/s, before emerging.

The pressures and speeds mentioned ensure very fine atomization. Droplet sizes with an average droplet diameter of 10 μm or less can be produced, which is considered ideal for the formation of a calm mist atmosphere in the cavity.

In summary, it is currently considered as the best parameter choice for generating the desired protective agent mist if use is made of a two-substance nozzle, within which anti-corrosion agent is atomized by gas, in particular air, wherein the volumetric flow of the anti-corrosion agent for atomization lies at below 100 g/min and the atomizing air is supplied at more than 100 m/s. In summary, the positive supply pressure of the air of 1.5 bar to 2.5 bar, and the supply pressure of the anti-corrosion agent of 2 bar to 4 bar are considered optimum.

The mist which can be produced by this means forms a fine mist atmosphere which is deposited on the walls of the cavity in the form of a thin and very homogeneous protective layer.

A further possibility of mist generation envisages an actuator vibrating at high frequency, for example a piezo-actuator or another form of an ultrasonic atomizer.

For all forms of mist generators and outlet openings, it can additionally be provided that they have a rotatable component, and therefore, during the emergence of the anti-corrosion agent, the outlet openings are in a rotational movement, which serves for the homogeneous distribution of the anti-corrosion agent.

A mist generation chamber can be connected upstream of the outlet opening. The mist generator can be designed for generating the protective agent mist in the mist generation chamber. A conveying device can be provided for conveying the protective agent mist to the outlet opening.

The mist generation chamber connected upstream serves for already generating a homogeneous mist before the latter is introduced into the cavity to be preserved. Said mist is supplied in homogenized form to the cavity by a conveying device, such as a pump, for conveying the protective agent mist or for generating a positive pressure in the mist generation chamber.

The method can be used for supplying the protective agent mist into a cavity between walls of a double-walled hollow body. It can furthermore be used for supplying the protective agent mist into a cavity, the inner walls of which are concealed, starting from the positioning of the outlet opening within the cavity, at least in sections by other wall sections. Surfaces of curved or angled cavities should advantageously also be provided with anti-corrosion agent by means of the method described. In particular in such configurations, better results can be achieved by the protective agent mist than by spraying protective waxes.

According to the invention, the system below is provided for carrying out the described method: the system has a working position at which a workpiece having a cavity to be preserved can be positioned. The system has a supply device for supplying an anti-corrosion agent into the cavity. The supply device has a mist generator with an outlet opening which can be positioned at or in the cavity to be preserved in such a manner that the anti-corrosion agent can be introduced in atomized form (protective agent mist) into the cavity.

The system can have air nozzles for the introduction of air for the purpose of moving the generated protective agent mist within the cavity.

The system can have at least one pressure generator, by means of which a negative pressure or a positive pressure can be generated in a partial region of the cavity. The pressure generator can be provided with a control device by means of which periodically changing pressure can be generated within the cavity.

The system is designed for generating a protective agent mist of the above-described type.

Furthermore, the system can have further components mentioned for the described method and in conjunction with the exemplary embodiments.

BRIEF DESCRIPTION OF THE DRAWINGS

Further advantages and aspects of the invention emerge from the claims and from the description below of preferred exemplary embodiments of the invention, which are explained below with reference to the figures.

DETAILED DESCRIPTION OF THE EXEMPLARY EMBODIMENTS

Figure 1:
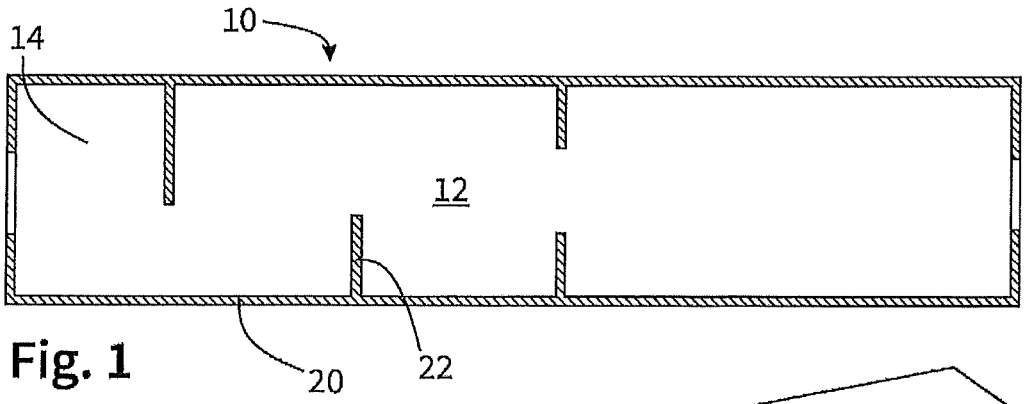
FIGS. 1 and 2 show an exemplary workpiece with a cavity, the surfaces of which are to be provided with anti-corrosion agent.
Figure 2:
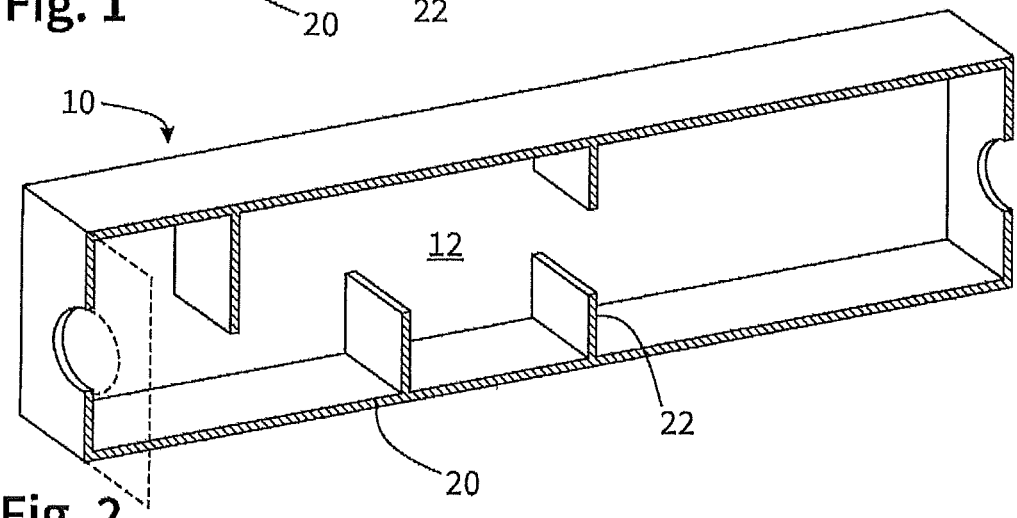

FIGS. 1 and 2 show an exemplary workpiece 10 which can be, for example, a subsection of a sill of a motor vehicle. FIG. 1 illustrates a sectioned view and FIG. 2 a perspective sectioned view. As can be seen, a cavity 12 of said sill is bounded not only by a cylindrical outer wall 20, but also by bulkhead plates 22.

It is the aim of the method described here to cover the surfaces within the cavity with anti-corrosion wax or a wax-based anti-corrosion agent. However, the bulkhead plates 22 mentioned make it impossible to reach all of the surfaces, starting from an end side region 14 of the cavity 12, by spraying anti-corrosion agent.

Figure 3:
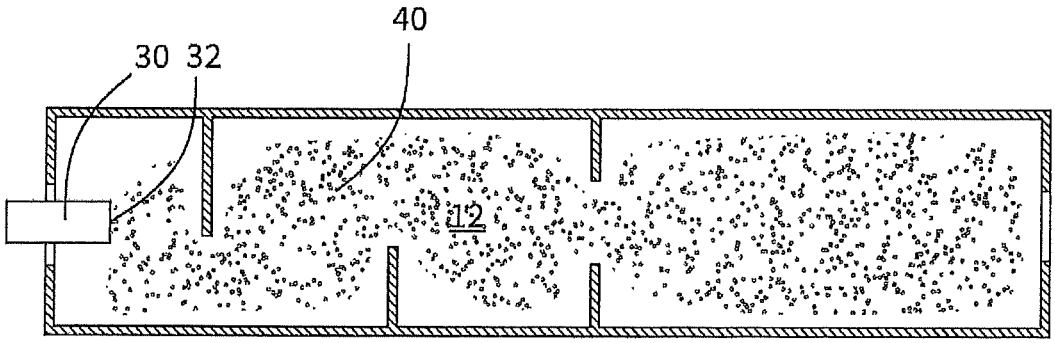
FIG. 3 shows the introduction of atomized anti-corrosion agent into the cavity through an outlet opening on an end side of the workpiece.

FIG. 3 shows how, in the case of the method according to the invention, an applicator 30 with a mist nozzle (not illustrated in the figure) having an outlet opening 32 on the end side is inserted into the cavity 12. The protective agent mist 40 is then introduced into the cavity 12 through the outlet opening 32 of the applicator. The protective agent mist 40 consists of fine droplets having an average diameter of below 60 μm. The protective agent mist 40 is distributed within the cavity 12 and is deposited on the surfaces of the outer wall 20 and the bulkhead plates 22.

The introduced mist should be differentiated from spraying, which is already known in the sphere of cavity preservation. The mist generation within the context of the invention and the known spraying agree in the provision of the liquid cavity preservative in the form of small droplets which are introduced into the cavity. However, in the case of the mist generation, it is provided that the average droplet diameter is smaller, preferably less than 30 μm, particularly preferably less than 10 μm, and that the droplets at least mostly do not strike directly against a wall of the hollow body and remain there, but rather form a mist atmosphere within the hollow body, said mist atmosphere moving only very slowly within the hollow body. The predominant quantity of the cavity preservative which is introduced into the cavity also does not enter into wall contact for 5 seconds after the introduction.

Figure 4:
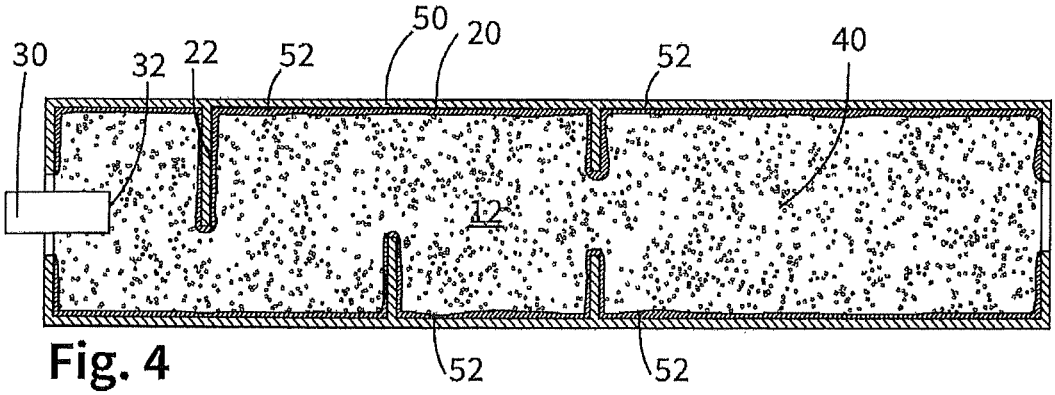
FIG. 4 shows the cavity after the anti-corrosion agent has been deposited on the walls.

FIG. 4 shows the cavity with a protective agent layer 50 which has been deposited on the walls. In particular, there is also a protective agent layer 50 in regions 52 which would not have been reachable directly from the outlet opening 32 by spraying, but only by means of the inclination of the protective agent mist 40 can be distributed homogeneously in the cavity 12 and can be deposited on the surfaces.

Figure 5:
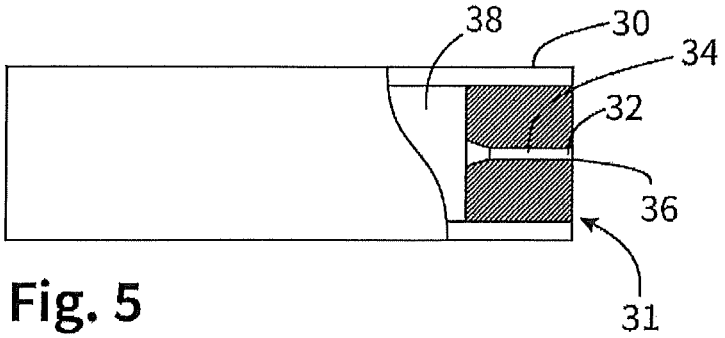
FIG. 5 shows a possible design of a mist generator in the form of a mist nozzle through which the anti-corrosion agent can be introduced and is atomized to form mist.

FIG. 5 shows by way of example a single-substance nozzle forming the mist generator 31. Said single-substance nozzle can be provided on the end side in the applicator 30. It has a thin nozzle channel 34, the opening of which defines the outlet opening 32, wherein, for the purpose of breaking up the anti-corrosion agent into fine drops, a sharp-edged configuration is provided at edges 36 of said outlet opening 32. The anti-corrosion agent is supplied under high pressure by a supply channel 38. The higher the pressure, the finer are the resulting droplets of the anti-corrosion agent. It is of particular advantage if the anti-corrosion agent in the channel 38 has a pressure of between 80 and 120 bar.

Figure 6:
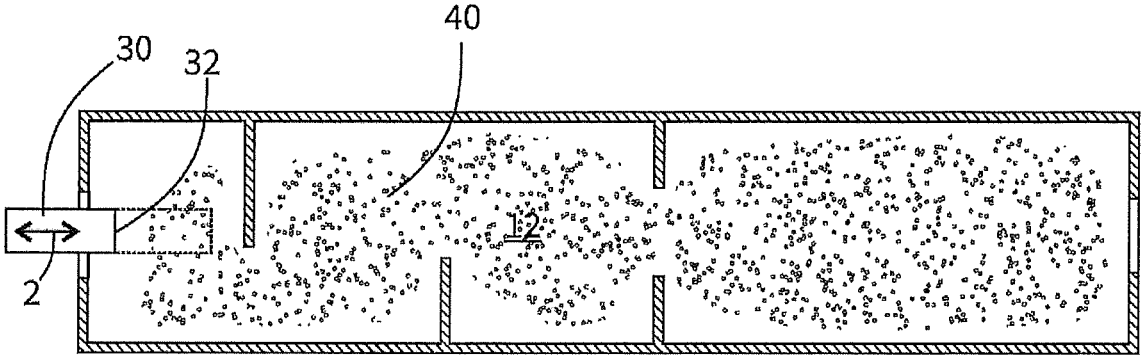
FIG. 6 shows a variant in which the mist discharge is improved by movement of the outlet opening.

FIG. 6 once again shows, similarly to FIG. 3, the introduction of the anti-corrosion agent into the cavity. The particular characteristic resides here in the fact that the outlet opening 32 is shifted within the cavity in the manner indicated by the arrow 2. By this means, an even more homogeneous distribution of the mist can be brought about. Depending on the penetration depth of the applicator 30 into the cavity, the required time needed until the mist has been homogeneously distributed can also be shortened. This serves for achieving short cycle times.

Figure 7A:
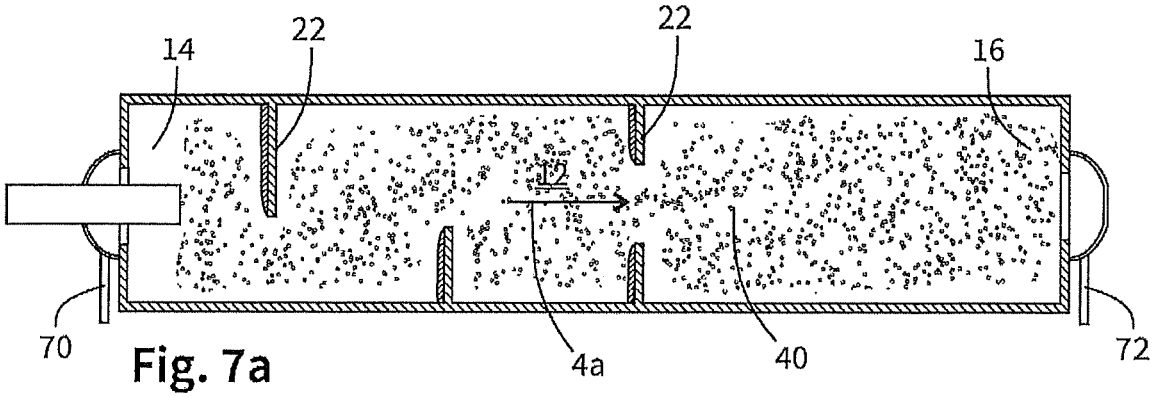
FIGS. 7*a* and 7*b* show a variant in which a movement of the protective agent mist is achieved by targeted generation of positive pressure and/or negative pressure in the hollow body.
Figure 7B:
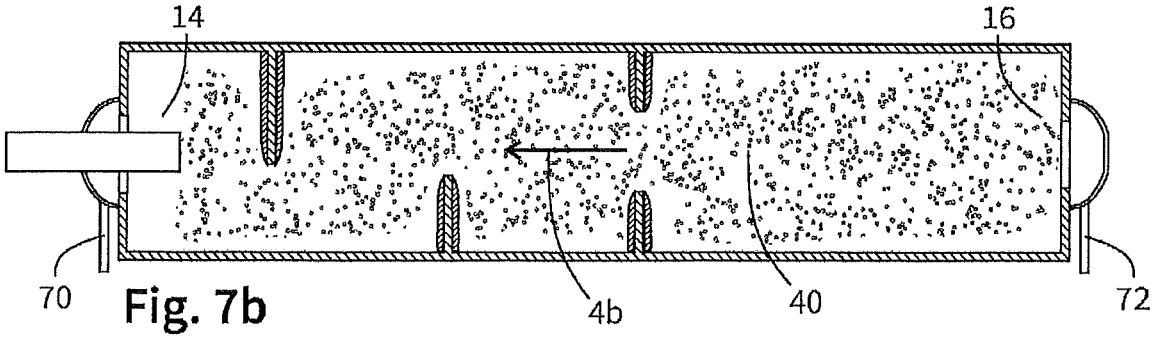

In the configuration according to FIGS. 7*a* and 7*b*, it is provided that pressure channels 70, 72 are in each case connected to the two opposite end regions 14, 16 of the cavity 12. Said pressure channels make it possible to allow a positive pressure or a negative pressure to arise in a targeted manner in the regions 14, 16. By this means, in turn, the mist cloud 40 can be moved to and fro in a targeted manner within the cavity 12, as indicated by the arrows 4*a*, 4*b*. In particular, the complete covering of the bulkhead plates 22 with anti-corrosion agent is thereby promoted.

The pressure channel 72 on the side opposite the nozzle can already be of advantage during the introduction of the mist cloud since it makes it possible, by introduction of air at the pressure channel 72 at the same time as mist droplets are introduced by the applicator 30, to generate an air cushion which prevents too high a portion of the droplets from being deposited directly on a wall of the cavity 12 because of their outlet speed.

Figure 8:
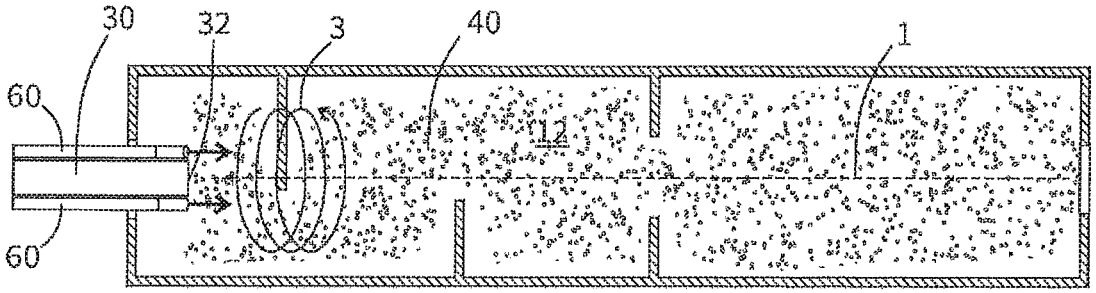
FIGS. 8 and 9 show variants in which a swirl is generated in the protective agent mist by the supply of air or by a particular alignment of mist outlet openings.

FIG. 8 shows a configuration in which, in addition to the applicator 30, two air nozzles 60 are inserted in the end region of the cavity, wherein said air nozzles in each case define an outlet direction of the air, said outlet direction not running solely in the main direction of extent 1 of the cavity 12, but rather, in each case by contrast, the two outlet directions being angled in the clockwise direction or the two outlet directions being angled counterclockwise. By this means, a helical swirl can be generated in the mist 40 which is brought about as if it were a type of screwing of the mist into the cavity and thereby in turn promotes the even covering of surfaces to which access is difficult.

Figure 9:
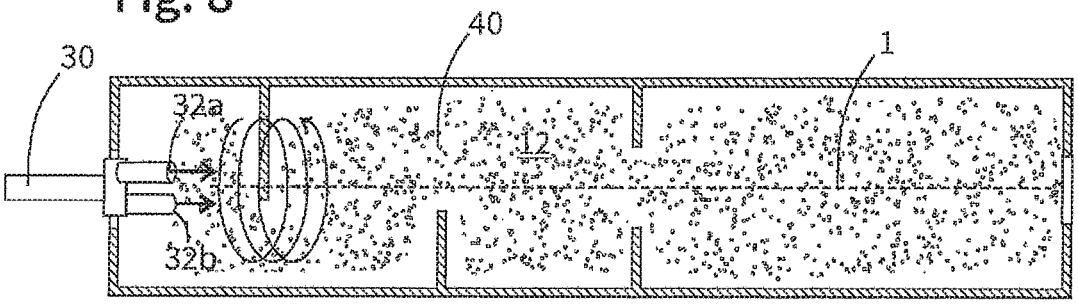

FIG. 9 shows that the same can also be achieved by the fact that the mist generator itself has two outlet openings 32*a*, 32*b* which are angled in an opposed manner in order to be able to generate the desired swirl. In addition, the applicator 30 can rotate as a whole.

Figure 10:
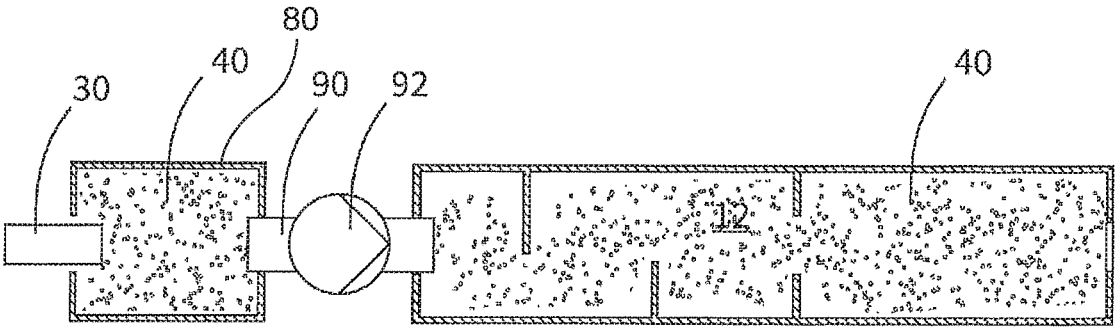
FIG. 10 shows a variant in which the mist generation takes place in a mist generation chamber not belonging to the workpiece, and the generated mist is only subsequently supplied to the cavity of the workpiece.

The configuration according to FIG. 10 has a significant difference. A mist generation chamber 80 belonging to the system and not to the workpiece is provided here, in which the protective agent mist 40 is generated by a mist nozzle. From here, the mist is supplied through a channel 90 to the actual cavity. This can take place via a pump 92 or, for example, in addition to the protective agent mist 40, via a separate channel by a positive pressure being caused in the mist generation chamber 80, said positive pressure forcing the protective agent mist 40 through the channel 90 into the workpiece.

Figure 11:
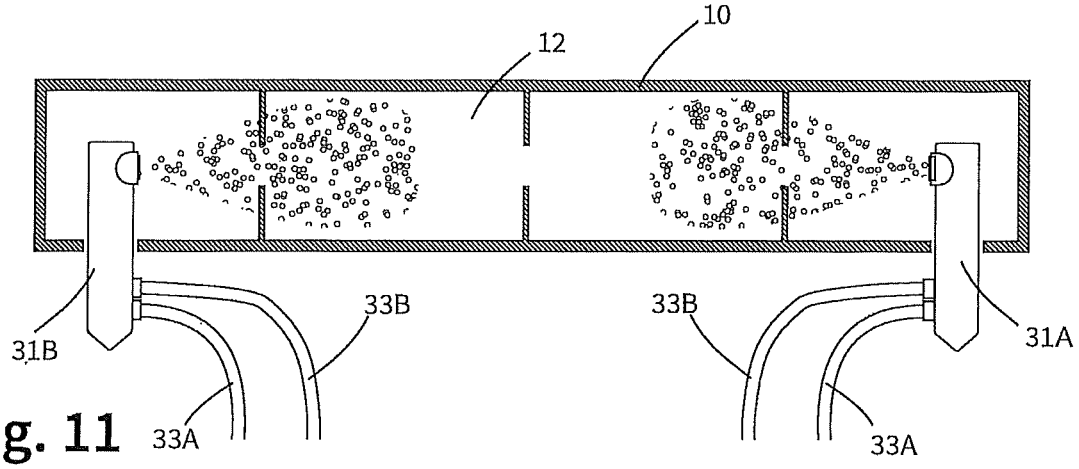
FIGS. 11, 12 and 13 show a variant in which mist generators are provided at the respective ends of the cavity.

FIG. 11 shows a further exemplary embodiment in which, in a departure from the preceding exemplary embodiments, mist generators 31A, 31B, each designed as two-substance mist nozzles, are in each case provided at two ends of the cavity with a protective agent layer. By way of example, these can be nozzles of the type Mod. 970/0 S4 from Dusen-Schlick GmbH from Untersiemau/Coburg. In the case of the exemplary embodiment of FIG. 11, these nozzles are inserted through lateral openings in the workpiece.

The mist generators 31A, 31B are supplied with anti-corrosion agent and air via lines 33A, 33B. Only a small volumetric flow of anti-corrosion agent of approximately 50 ml/min is supplied here. The actual atomization at the outlet nozzle of the mist generators 31A, 31B takes place by feeding in the air at a speed of approximately 250 m/s and at positive infeed pressures of 2 bar in the case of the air and 3 bar in the case of the anti-corrosion agent. The result is the generation of a mist with an average droplet size of approximately 10 μm. The mist cloud emerges from the mist generator in the form of a cone, wherein the speed in the center of said cone is approximately 16 m/s and decreases rapidly to the outside to below 10 m/s. By the droplets being small, said droplets undergo a severe deceleration directly after the outlet because of the air resistance. This effect is also reinforced by an air cushion which is brought about by the mist generator which is in each case opposite.

Figure 12:
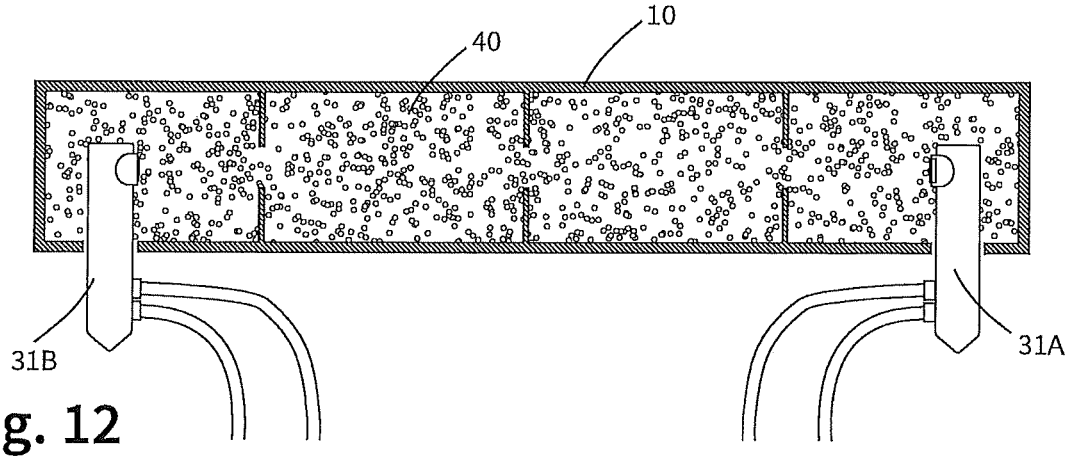
Figure 13:
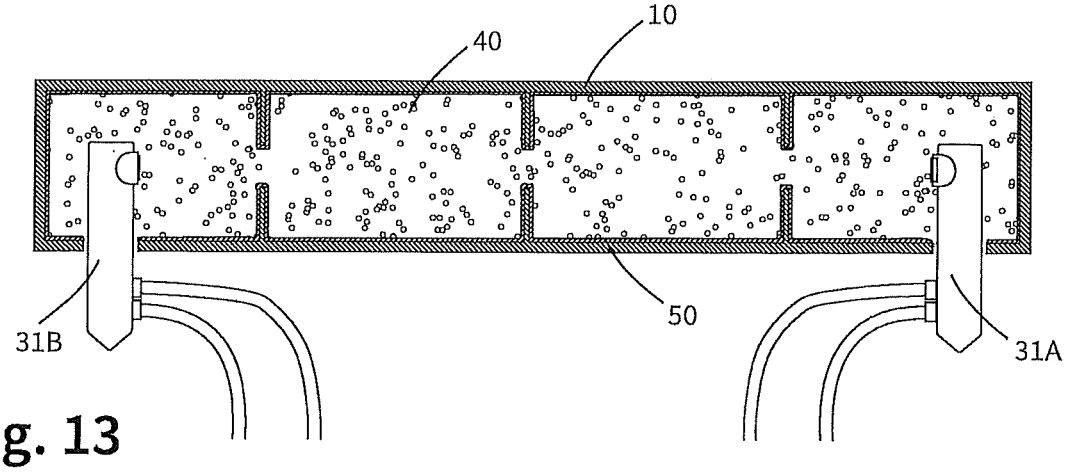

The fine droplet size and the action of said air cushions has the effect that the predominant amount of the introduced anti-corrosion agent first of all forms a stationary or only slightly moving mist atmosphere, the droplets of which remain in the suspended state for at least 5 seconds before they are deposited on a wall. FIGS. 12 and 13 show this phase of the mist formation and the deposition.

It has been shown that, by means of iterative introduction of the anti-corrosion agent, a mist atmosphere which is readily suitable for coating purposes is likewise arrived at with only one mist generator. The introduction can take place, for example, in a phase of a length of 2 to 3 seconds, which is then followed by a short phase of 1 to 3 seconds when the mist generator is deactivated.

Figure 14:
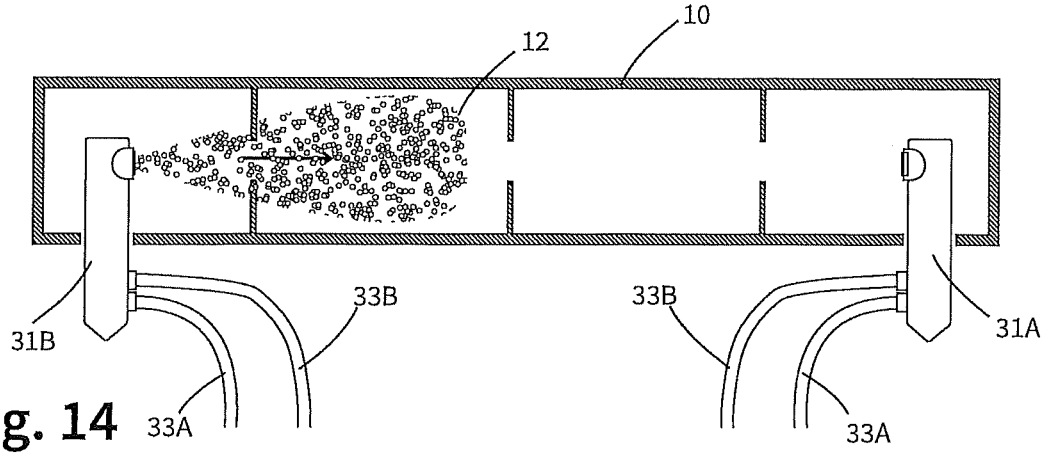
FIGS. 14-16 show a variant in which the protective agent is introduced into the cavity iteratively.
Figure 15:
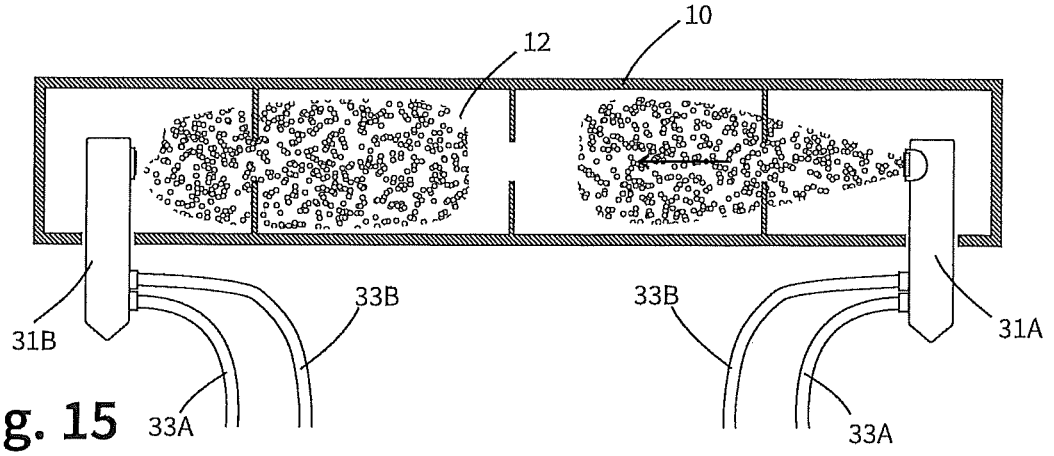
Figure 16:
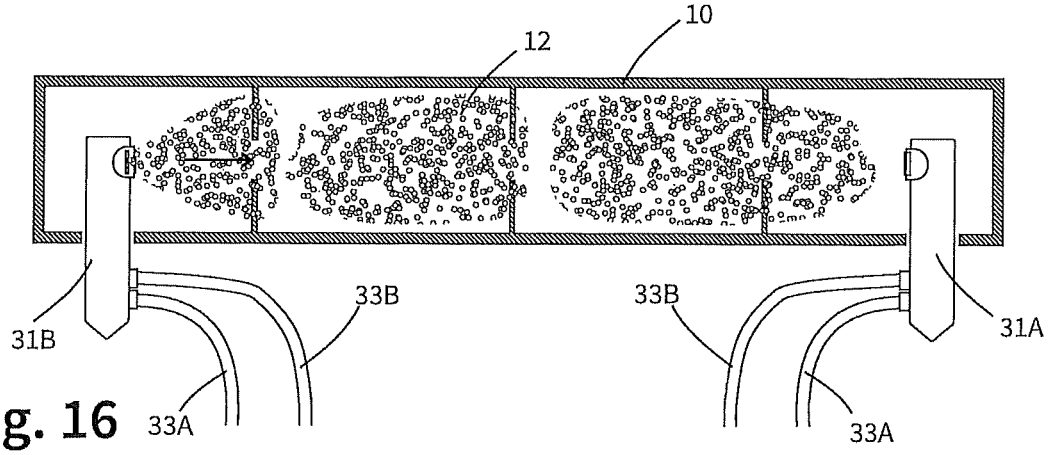

FIGS. 14 to 16 show this using an example with two mist generators 31A, 31B. First of all, mist is generated by means of the mist generator 31B which is on the left in the figures, as FIG. 14 shows. Subsequently, the mist generation starts here and the mist generator 31A which is on the right in the figures outputs mist made of anti-corrosion agent. By means of the opposed discharge direction, the two mist clouds have a mutually braking effect. The discharge is then continued in turn with a discharge operation at the left mist generator 31B. The desired dense mist cloud 40 consisting of very fine droplets then arises incrementally, and the droplets are then deposited on the walls in the manner already described.

Although, in the case of the exemplary embodiment of FIGS. 14 to 16, two mist generators are illustrated, even when only one mist generator is used, it has been shown that the iterative or pulsing output of protective agent mist—i.e. the repeated activation and deactivation of the output of the protective agent mist—in comparison to an uninterrupted output leads to improved formation of the mist atmosphere from anti-corrosion agent and to a smaller portion of droplets directly impacting against walls.

The invention claimed is:

1. A method for covering inner walls of a cavity of a vehicle body or an add-on part for a vehicle body with a protective layer made of an anti-corrosion wax or a wax-based anti-corrosion agent, including the following steps:

an anti-corrosion wax or a wax-based anti-corrosion agent is brought by a mist generator into an atomized form as a protective agent mist and the protective agent mist is supplied through an outlet opening to the cavity of the vehicle body or the add-on part for the vehicle body to be preserved, wherein the protective agent mist consists of air and droplets of the anti-corrosion wax or the wax-based anti-corrosion agent, and the average diameter of the droplets of the protective agent mist is <60 μm, and the protective agent mist is deposited on inner walls of the cavity of the vehicle body or the add-on part for the vehicle body and forms an anti-corrosion agent layer on the inner walls.

2. The method as claimed in claim 1, wherein the average diameter of the droplets of the protective agent mist is <30 μm.

3. The method as claimed in claim 2, wherein the average diameter of the droplets of the protective agent mist is <10 μm.

4. The method as claimed in claim 1, wherein the droplets of the protective agent mist emerge from the outlet opening at a speed of <10 m/s.

5. The method as claimed in claim 1, wherein the supplying of the protective agent mist into the cavity occurs at a first introduction point, and during the supplying of the protective agent mist into the cavity at the first introduction point, a gas is supplied to the cavity at a second introduction point different from the first introduction point in order to influence a flow direction of the protective agent mist in the cavity and/or in order to reduce the speed of the protective agent mist in the cavity.

6. The method as claimed in claim 1, wherein a volumetric flow of the protective agent mist which is supplied to the cavity is less than 200 g/minute.

7. The method as claimed in claim 1, wherein the protective agent mist is supplied at a plurality of points or at alternating points within the cavity to be preserved, and/or the protective agent mist is supplied by a plurality of mist generators and/or through a plurality of outlet openings which are arranged at different points within the cavity to be preserved and/or are arranged in different directions relative to the cavity to be preserved.

8. The method as claimed in claim 1, wherein the protective agent mist is moved within the cavity by generation of a pressure difference between two spaced-apart partial regions of the cavity.

9. The method as claimed in claim 1, wherein a periodically repeated movement of the protective agent mist is generated in the cavity by alternating generation of a positive pressure and a negative pressure in at least one partial region of the cavity.

10. The method as claimed in claim 1, wherein the mist generator is operated at least in phases in a pulsed mode in which parameters of the mist generation change in an alternating manner, or in which the mist generation is interrupted in phases.

11. The method as claimed in claim 10, wherein in the pulsed mode, the alternating parameters change or the interruptions in the mist generation take place at an average frequency of between 0.1 Hertz and 5 Hertz.

12. The method as claimed in claim 1, wherein the mist is generated by at least two mist generators which are operated such that a first of the two mist generators and a second of the two mist generators alternately discharge relatively greater volumetric flow of protective agent mist.

13. The method as claimed in claim 1, where the mist generator generates the protective agent mist by mixing pressurized anti-corrosion wax or wax-based anti-corrosion agent and pressurized air.

14. The method as claimed in claim 13, wherein for the purpose of atomizing the anti-corrosion wax or the wax-based anti-corrosion agent, the air is accelerated within a two-substance nozzle to at least 100 m/s.

15. The method as claimed in claim 13, wherein for the purpose of atomizing the anti-corrosion wax or the wax-based anti-corrosion agent, the anti-corrosion wax or the wax-based anti-corrosion agent is supplied to the mist generator at a speed of 2 m/s (+/−0.5 m/s).

16. The method as claimed in claim 13, wherein the air is supplied to the mist generator at a positive pressure of between 1 bar and 3 bar for mixing with the anti-corrosion wax or the wax-based anti-corrosion agent.

17. The method as claimed in claim 13, wherein the anti-corrosion wax or the wax-based anti-corrosion agent is supplied to the mist generator at a positive pressure of between 1 bar and 3 bar for mixing with the air.

18. The method as claimed in claim 1, wherein the mist generator generates the protective agent mist by pressurized forcing of the anti-corrosion wax or the wax-based anti-corrosion agent through a nozzle opening, or the mist generator generates the protective agent mist by means of an actuator vibrating at high frequency.

19. The method as claimed in claim 1, wherein the mist generation takes place through at least one nozzle opening with a diameter of less than 0.5 mm, and the anti-corrosion wax or the wax-based anti-corrosive agent is supplied to the nozzle opening at a pressure of at least 20 bar.

20. The method as claimed in claim 1, wherein the protective agent mist emerges from the outlet opening in a direction which is angled in relation to a main direction of extent of the cavity, and/or after emerging from the outlet opening, the protective agent mist is influenced in a targeted manner in respect of its movement direction.

21. The method as claimed in claim 1, wherein a mist generation chamber is connected upstream of the outlet opening, and the mist generator is configured for generating the protective agent mist in the mist generation chamber.

22. The method as claimed in claim 1, wherein the method is used for supplying the protective agent mist into the cavity, the cavity being located between walls of a double-walled hollow body of the vehicle body or the add-on part for the vehicle body, or the method is used for supplying the protective agent mist into the cavity, the cavity having inner walls which are concealed, starting from the positioning of the outlet opening within the cavity, at least in sections by other wall sections.

* * * * *